US005833502A

United States Patent [19]

Anderson

[11] Patent Number: 5,833,502

[45] Date of Patent: Nov. 10, 1998

[54] BOAT CONSTRUCTION

[76] Inventor: Carl J. Anderson, 4317 S. River Rd., East China, Mich. 48054

[21] Appl. No.: 666,137

[22] Filed: Jun. 19, 1996

[51] Int. Cl.[6] ..... B63H 5/16

[52] U.S. Cl. ..... 440/69; 440/54; 114/343

[58] Field of Search ..... 114/288, 291, 114/271, 343; 440/69, 70, 53, 54

[56] References Cited

U.S. PATENT DOCUMENTS

| | | | |
|---|---|---|---|
| Re. 31,563 | 4/1984 | Stout et al. . | |
| 1,318,413 | 10/1919 | Rume . | |
| 1,396,831 | 11/1921 | Gardner . | |
| 2,134,042 | 10/1938 | Hoffman . | |
| 2,522,545 | 9/1950 | Sharp | 440/53 |
| 2,844,120 | 7/1958 | Nelson | 440/53 |
| 3,040,697 | 6/1962 | Federico et al. | 440/69 |
| 3,177,836 | 4/1965 | Salamin . | |
| 3,452,704 | 7/1969 | Watkins | 440/57 |
| 3,469,549 | 9/1969 | Rae . | |
| 3,469,557 | 9/1969 | Wollard | 440/69 |
| 3,548,428 | 12/1970 | Eades | 440/54 |
| 3,661,109 | 5/1972 | Weiland . | |
| 3,763,810 | 10/1973 | Payne . | |
| 3,811,399 | 5/1974 | Kobayashi et al. | 440/69 |
| 4,192,248 | 3/1980 | Moyer . | |
| 4,231,314 | 11/1980 | Peters . | |
| 4,300,889 | 11/1981 | Wormser . | |
| 4,371,350 | 2/1983 | Kruppa et al. . | |
| 4,383,828 | 5/1983 | Wynne . | |
| 4,509,927 | 4/1985 | Ikeda . | |
| 4,609,360 | 9/1986 | Whitehead . | |
| 4,652,245 | 3/1987 | May . | |
| 4,915,668 | 4/1990 | Hardy . | |
| 4,924,797 | 5/1990 | Solia . | |
| 4,940,436 | 7/1990 | Newman . | |
| 4,957,056 | 9/1990 | Martin | 114/361 |
| 4,977,845 | 12/1990 | Rundquist . | |
| 5,111,767 | 5/1992 | Haines . | |
| 5,143,013 | 9/1992 | Huebner | 114/361 |
| 5,203,728 | 4/1993 | Kobayashi . | |
| 5,211,126 | 5/1993 | Johnson . | |
| 5,231,945 | 8/1993 | Ackerbloom . | |
| 5,317,982 | 6/1994 | Jagers . | |
| 5,351,642 | 10/1994 | Ackerbloom . | |
| 5,390,624 | 2/1995 | Barnes . | |
| 5,405,278 | 4/1995 | Garland . | |
| 5,427,048 | 6/1995 | Takeuchi . | |
| 5,443,026 | 8/1995 | Wenstadt et al. . | |
| 5,452,675 | 9/1995 | Devin . | |
| 5,474,014 | 12/1995 | Russell . | |
| 5,476,061 | 12/1995 | Ackerbloom . | |

*Primary Examiner*—Sherman Basinger
*Attorney, Agent, or Firm*—Edgar A. Zarins; Malcolm L. Sutherland

[57] ABSTRACT

A boat construction incorporating unique structural features for improved performance at a variety of speeds and water depths. The hull of the boat incorporates a deep-V forward section and a rear tunnel section extending longitudinally rearward from a midpoint of the boat. A vertically adjustable outboard is positioned at the forward end of the tunnel section of the hull. The outboard engine may be vertically adjusted to accommodate different water depths and operational requirements. The engine is positioned within a console above the midpoint for convenient maintenance access and insulation against engine noise. Steering may be accomplished by rotating the engine itself or separately through rudders mounted to the hull. The center mounting of the engine in conjunction with the tunnel section of the hull reduces planing upon acceleration, improves center of gravity and reduces the risk to swimmers and water skiers from a rear mounted propeller.

15 Claims, 2 Drawing Sheets

BOAT CONSTRUCTION

BACKGROUND OF THE INVENTION

I. Field of the Invention

This invention relates to a construction of a boat for improved operating characteristics and, in particular, to a boat with a dual configuration hull including a rear tunnel section and an engine mounted at a midpoint of the boat proximate the forward end of the tunnel section and vertically adjustable as needed.

II. Description of the Prior Art

Boat constructions, particularly the shape of the hull, have been varied time and again to product optimum operation of the boat in a wide variety of conditions. While the overall size of the boat limits the type of seas manageable by the boat, different hull shapes and engines affect the operating characteristics of the boat. Tradeoffs include greater stability versus greater speed and the capability to cut through rough seas or operating in shallow water depths.

The typical boat incorporates a V-shape hull extending from a forward point and widening to the rear of the boat allowing the hull to "cut" through the water. The depth of the V-shape dictates the performance characteristics of the boat. A flatter hull provides greater stability and is used on barges and fishing boats. A deeper V improves the ability of the boat to cut across the water with less drag and greater efficiency. The engine of a boat can be inboard or outboard allowing convenient access for maintenance and removal. In either situation, the engine is typically mounted at the rear of the boat to propel the boat through the water as well as allow convenient maintenance. Whether the boat is provided with an inboard or an outboard motor, the propellers are positioned just outside the aft wall where swimmers and skiers may come in contact with the propellers. Positioning the motor at the rear of the boat causes the boat to plane at a severe angle upon acceleration which reduces visibility and can damage the propeller in shallow waters. Nevertheless, the motor has been traditionally mounted at the rear or aft of the boat for ease of mounting and maintenance. This convenience also subjects the boat motor to easy tampering and theft.

SUMMARY OF THE PRESENT INVENTION

The present invention overcomes the disadvantages of the prior known boat constructions by providing a center mounted boat motor which is vertically adjustable within a center well and disposed at the forward end of a tunnel section of the hull to propel the boat.

The boat of the present invention includes a hull with a typical deep-V forward section and a rear tunnel section. The tunnel section of the hull has an arcuate tunnel extending longitudinally from approximately a midpoint in the boat out the transom. The tunnel is formed by a pair of parallel side portions resembling pontoons and incorporating a smaller V-shape on each side of the tunnel. In addition to providing less drag because of the reduction in hull surface area, greater stability is provided with flatter turns since the turn pressure is moved to the inside edge of the tunnel.

In conjunction with the tunnel section of the hull, the boat motor is mounted at approximately the center of the boat such that the propeller is positioned at the forward end of the tunnel section. A well is formed through the boat body in communication with the tunnel section of the hull. The boat motor is mounted within the well on a hydraulic rack to allow vertical adjustment of the motor to alter the operating characteristics of the boat under different conditions. The thrust created by the propeller is driven out through the tunnel to propel the boat. The center positioning of the boat motor improves the center of gravity of the boat improving stability while also reducing planing upon acceleration thereby improving visibility and operation in shallow water. Since the propeller is positioned beneath the boat, swimmers and skiers will not come in contact with the propeller. Additionally, the engine can be accessed from all sides while positioned in the well which also improves passenger movement around the boat allowing access to the aft of the boat. In a preferred embodiment, the boat motor well is enclosed by an insulated housing which forms the operations console for the boat. As a result, engine noise is greatly reduced and the motor is protected from tampering and the elements. The console housing is hinged to permit access to the boat motor.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
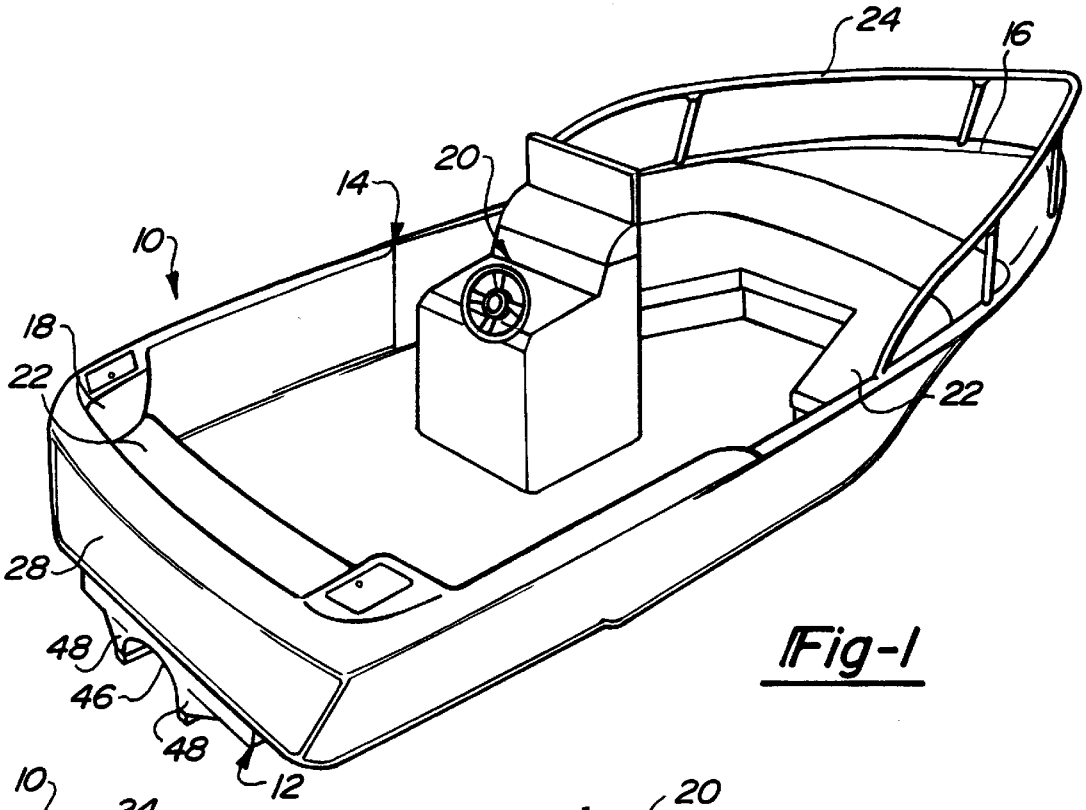
FIG. 1 is a perspective view of a boat embodying the present invention.

Referring first to FIG. 1, there is shown a boat 10 of a typical configuration with a hull 12 adapted to engage the water and a deck or body 14 to accommodate passengers. The boat 10 includes a fore or front portion 16 which comes to a point or "V" and an aft or rear portion 18. Disposed on the deck 14 is a control console 20 facilitating control of the boat 10 including direction and speed while allowing convenient monitoring of operation. Additional amenities may include seating 22 and safety rails 24.

Figure 2:
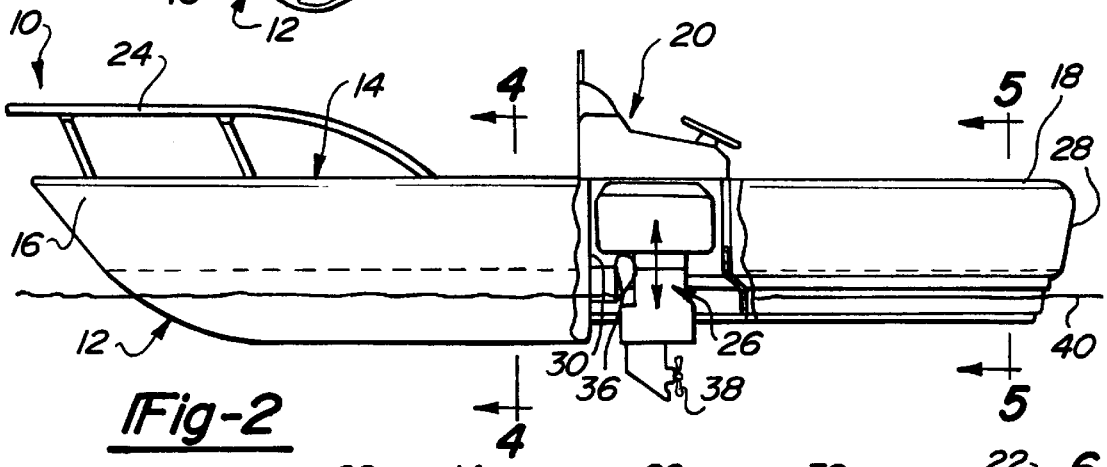
FIG. 2 is a side view thereof.
Figure 3:
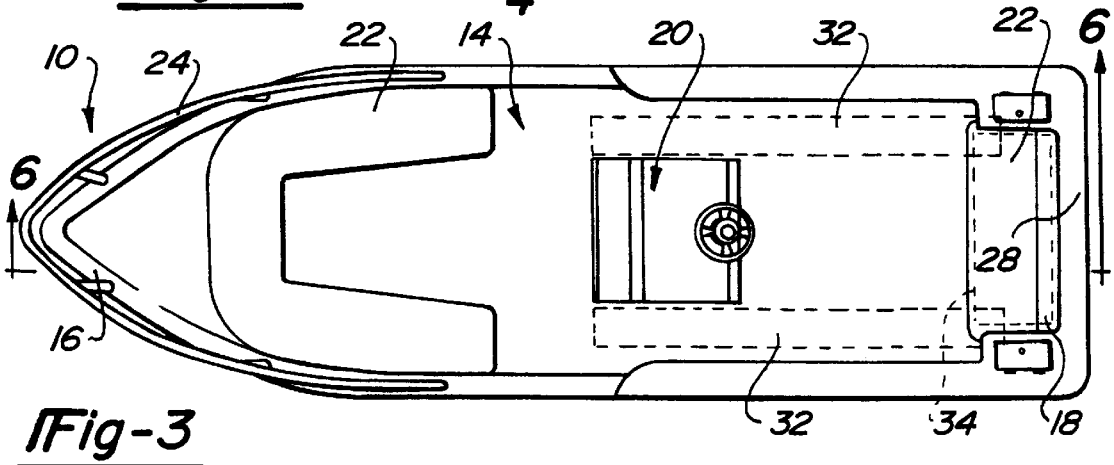
FIG. 3 is a top plan view thereof.

Referring now to FIGS. 1 through 3, the boat 10 includes a boat motor 26 mounted forward of the aft transom 28. The motor 26 is mounted within a well 30 formed in a midsection of the boat 10 and extending through the boat 10. In a preferred embodiment, the control console 20 fits over the well 30 to enclose the boat motor 26. The console 20 may simply lift off of the well 30 or may be hingedly mounted to the well 30 to pivot off of the well 30 allowing access to the motor 26. The boat motor 26 mounted in the well 30 facilitates access to the motor 26 from all sides as opposed to just one side of motors which are mounted at the aft transom 28. By insulating the console housing 20, noise from the motor 26 can be substantially reduced for what is essentially an outboard motor 26. The proximity of the control console 20 to the motor 26 also improves operating efficiency while reducing manufacturing costs since hoses, cables and electrical lines between the motor 26 and controls 20 are substantially shortened. The boat construction of the present invention also improves fuel delivery by mounting a pair of fuel tanks 32 alongside the boat motor well 30. An additional fuel tank 34 is disposed beneath the rear seat 22 of the boat 10 thereby providing improved fuel capacity.

The boat motor 26 is mounted to a rack 36 within the well 30 to control the vertical position of the motor 26 and in particular the propeller 38 with respect to the waterline 40. By varying the position of the motor 26 and propeller 38 operation of the boat 10 will be altered. In particular, raising the motor 26 allows operation of the boat 10 in shallow water while lowering the motor 26 improves acceleration in sufficient water depths. In one embodiment, direction of the boat 10 may be controlled simply by pivoting the motor 26 which acts as a rudder. Alternatively, separate rudders may be mounted to the hull 12 of the boat 10 to control direction. Positioning of the motor 26, motor speed and direction are all controlled through the console 20 mounted over the motor 26.

Figure 4:
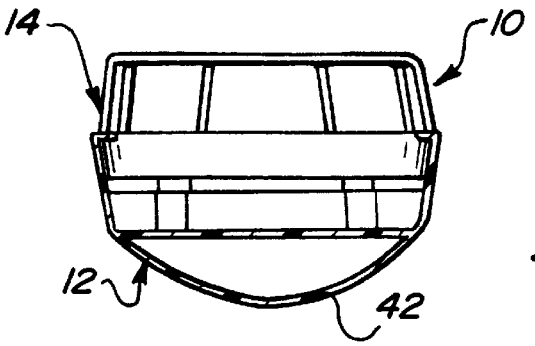
FIG. 4 is a transverse cross-sectional view taken along lines 4—4 of FIG. 2.
Figure 5:
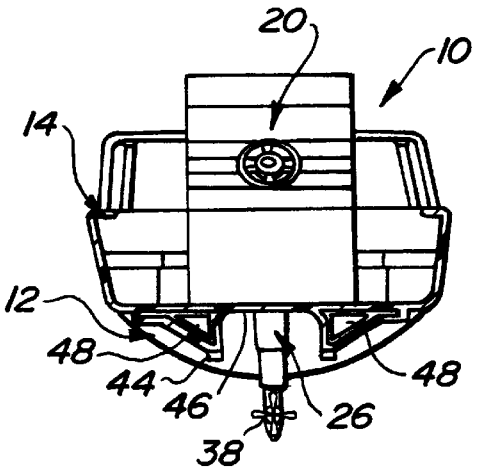
FIG. 5 is a transverse cross-sectional view taken along lines 5—5 of FIG. 2.
Figure 6:
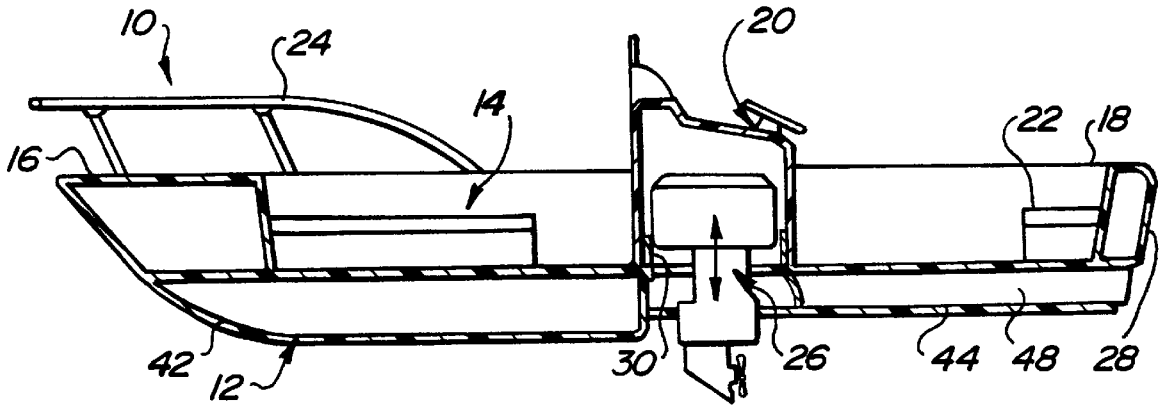
FIG. 6 is a longitudinal cross-sectional view taken along lines 6—6 of FIG. 3.

Referring now to FIGS. 4 through 6, the midsection mounted boat motor 26 operations in conjunction with a unique hull 12 configuration to provide the advantages of the present invention. The hull 12 includes a conventional deep-V forward section 42 and a rear tunnel section 44. The deep-V forward section 42 begins at a forward point and widens for stability allowing the boat 10 to cut through the water and any waves. The forward section 42 ends at the motor well 30 at a midsection of the boat 10. The tunnel section 44 of the hull 12 includes a longitudinal passageway 46 running from the motor well 30 rearward through the transom 28 creating a tunnel through the rear of the boat. A pair of small V-shaped hull portions 48 are formed on opposite sides of the passageway 46. The small hull portions 48 operate similar to portions stabilizing the boat 10 while forming the tunnel passageway 46 in the rear section of the hull 12. The motor well 30 is in communication with the passageway 46 such that the boat motor 26 is positioned at the forward end of the tunnel passageway 46. The specific configuration of the tunnel passageway 46 and small hull portions 48 may be optimized for improved stability and operation of the boat 10. However, the preferred embodiment of the present invention simply contemplates the small hull portions 48 forming the longitudinal tunnel passageway 46 in communication with the motor well 30 such that the motor 26 is positioned at the forward end of the tunnel passageway 46 directing its thrust through the passageway 46.

The boat construction of the present invention provides numerous advantages stemming primarily from positioning the boat motor 26 at a midsection of the boat 10 in conjunction with the rear tunnel section 44 of the hull. Midsection mounting of the motor 26 creates a better center of gravity for the boat 10 also allowing better acceleration with less bow lift or planing out while accelerating. Fishermen are able to move all around the boat without concern for the boat motor 26 and propeller 38 at the rear of the boat 10. Similarly, swimmers and skiers will not come in contact with the propeller mounted under a midsection of the boat 10. With the motor 26 mounted with the well 30 and housed by the console 20, the motor 26 is protected from theft and tampering as well as from the elements.

The dual sectioned hull 12 improves speeds since less drag is created with less hull surface area against the water. Additionally, the boat 10 turns quicker and flatter because the turning pressure against the water has moved to the inside edge of the tunnel passageway 46. Finally, it has been found that the hull 12 creates little or no wake at low speeds.

The foregoing detailed description has been given for clearness of understanding only and no unnecessary limitations should be understood therefrom as some modifications will be obvious to those skilled in the art without departing from the scope and spirit of the appended claims.

What is claimed is:

1. A boat construction having a boat body with a boat deck adapted to accommodate passengers and a boat hull said boat construction comprising:

a boat motor mounted within a midsection of the boat body intermediate fore, aft, starboard and port sides of said boat, said boat motor extending through the boat deck and having a propeller on a lower end of said boat motor;

a control console having a means for controlling said boat motor and said boat and means for monitoring operation of said boat, said control console disposed on the boat deck over said boat motor to enclose said boat motor; and a tunnel hull section including a longitudinal tunnel passageway extending from said midsection boat motor rearwardly through an aft transom of said boat hull, said propeller of said boat motor operatingly disposed with a forward end of said tunnel passageway, said tunnel passageway having substantially vertical side walls and a concave upper wall.

2. The boat construction as defined in claim 1 wherein said boat motor is disposed within a motor well in communication with said tunnel passageway, said motor well extending through the boat deck facilitating access to said boat motor.

3. The boat construction as defined in claim 2 wherein said control console is hingedly mounted to the boat deck facilitating selective access to said boat motor.

4. The boat construction as defined in claim 2 wherein said control console includes sound insulation for noise reduction.

5. The boat construction as defined in claim 2 and further comprising means for adjusting the position of said boat motor within said motor well.

6. The boat construction as defined in claim 5 wherein said means for adjusting the position of said boat motor within said motor well includes vertical adjustment means to vary the vertical position of said boat motor propeller within said tunnel passageway.

7. The boat construction as defined in claim 6 wherein said rear tunnel hull section includes a pair of substantially V-shaped hull portions extending longitudinally along opposite sides of said tunnel passageway, said side walls of said tunnel passageway forming a side of said V-shaped hull portions.

8. The boat construction as defined in claim 6 wherein the boat hull includes a deep-V hull configuration forward of said rear tunnel hull section.

9. A boat construction having a boat body with a boat deck adapted to accommodate passengers and a boat hull, said boat construction comprising:

a motor well formed vertically through a midsection of the boat body intermediate fore, aft, starboard and port sides of said boat;

a boat motor removably disposed within said motor well and extending downwardly through said motor well, said boat motor including a propeller on a lower end of said boat motor;

a control console having means for controlling said boat motor and means for monitoring operation of said boat, said control console disposed on the boat deck over said motor well to enclose said motor within said well;

means for adjusting the orientation of said boat motor within said motor well including adjusting the vertical position of said boat motor within said motor well; and a tunnel hull section including a longitudinal tunnel passageway in communication with said motor well and extending rearwardly from said midsection boat motor well through the aft of the boat body, said boat motor disposed substantially at a forward end of said tunnel passageway such that said propeller is operatingly disposed within said passageway, said tunnel passageway having substantially vertical side walls and a concave upper wall.

10. The boat construction as defined in claim 9 wherein said control console is hingedly mounted to the boat deck facilitating selective access to said boat motor.

11. The boat construction as defined in claim 10 wherein said control console includes sound insulation for noise reduction.

12. The boat construction as defined in claim 9 wherein said tunnel passageway of said rear tunnel hull section includes substantially vertical side walls and a concave upper wall.

13. The boat construction as defined in claim 12 wherein said rear tunnel hull section includes a pair of substantially V-shaped hull portions extending longitudinally along opposite sides of said tunnel passageway, said side walls of said tunnel passageway forming a side of said V-shaped hull portions.

14. The boat construction as defined in claim 9 wherein the boat hull includes a deep-V hull configuration forward of said rear tunnel hull section.

15. A boat construction having a boat body with a boat deck adapted to accommodate passengers and a boat hull, said boat construction comprising:

a forward hull section having a deep-V hull configuration;

a tunnel hull section extending rearwardly from said forward hull section, said tunnel hull section including a longitudinal tunnel passageway extending rearwardly from a midsection of the boat hull through the aft transom of the boat body, said tunnel passageway having a concave upper wall and substantially vertical side walls forming a pair of substantially V-shaped hull portions extending longitudinally along opposite sides of said tunnel passageway;

a motor well formed vertically through a midsection of the boat body intermediate fore, aft, starboard and port sides of said boat, said motor well in communication with said tunnel passageway of said tunnel hull section at a forward end of said tunnel passageway;

a boat motor removably disposed within said motor well and having a propeller at least partially disposed within said tunnel passageway; and a control console disposed on the boat deck over said motor well to enclose said boat motor within said well, said control console having means for monitoring operation of said boat and means for adjusting the orientation of said boat motor propeller relative to said tunnel passageway to alter the operating characteristics of said boat.

* * * * *